United States Patent [19]

Flaig et al.

[11] Patent Number: 4,490,051

[45] Date of Patent: Dec. 25, 1984

[54] ELECTROMECHANICAL SHORT INTERVAL TIMER

[75] Inventors: Hans Flaig, Schramberg; Egon Rapp, Schonbronn; Herrmann Brede, Schiltach; Wolfgang Ganter, Schramberg, all of Fed. Rep. of Germany

[73] Assignee: Gebruder Junghans GmbH, Schramberg, Fed. Rep. of Germany

[21] Appl. No.: 550,626

[22] Filed: Nov. 10, 1983

[51] Int. Cl.[3] ..... G04F 8/00

[52] U.S. Cl. ..... 368/109

[58] Field of Search ..... 368/107-113, 368/117, 118, 243, 244, 250

[56] References Cited

U.S. PATENT DOCUMENTS

| | | | |
|---|---|---|---|
| 3,431,720 | 3/1969 | Ehner et al. | 368/108 |
| 3,713,285 | 1/1973 | Haupe | 368/108 |
| 3,789,600 | 2/1974 | Champan | 368/110 |
| 4,222,226 | 9/1980 | Miyatake et al. | 368/113 |

FOREIGN PATENT DOCUMENTS 8024739 9/1980 Fed. Rep. of Germany .

*Primary Examiner*—Vit W. Miska

*Attorney, Agent, or Firm*—Burns, Doane, Swecker & Mathis

[57] ABSTRACT

An electromechanical short interval timer has an actuating dial which can be manually rotated from a rest position to establish a time-elapse period. An electric motor returns the dial to its rest position. A timing circuit delivers electric pulses to drive the motor. A frequency selector switch is connected to or within the timing circuit whereby the pulse frequency can be varied. In this way, the time elapse period which is set by a given amount of dial rotation can be varied in a simplified manner. The dial activates a signal emitter before reaching its rest position, and simultaneously activates a timer circuit to continue returning the dial to its rest position. The dial engages a movable stop at both ends of its 360 degree travel stroke which assumes that the dial travels exactly 360 degrees.

22 Claims, 18 Drawing Figures

FIG. 6
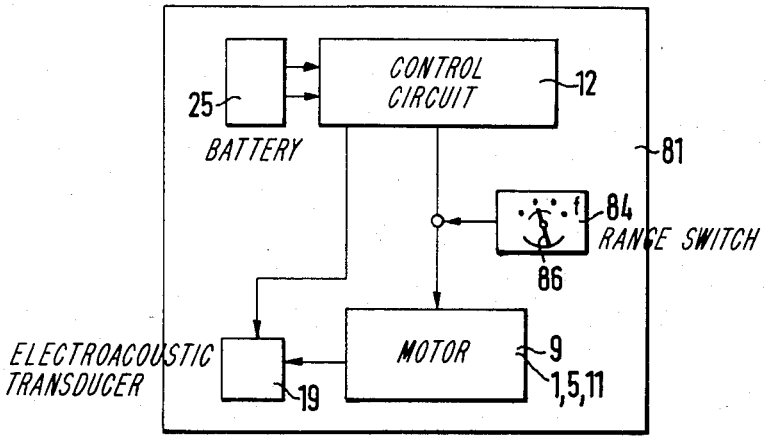
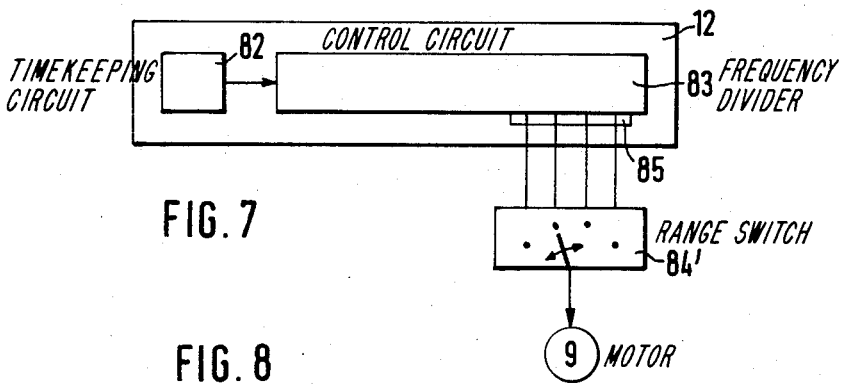
FIG. 7
FIG. 8
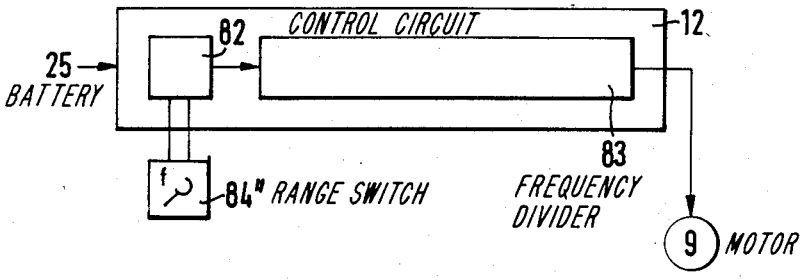

FIG. 9
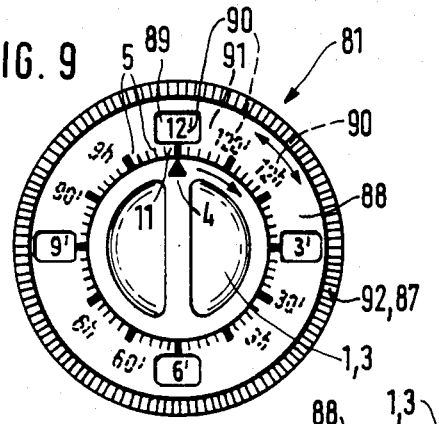
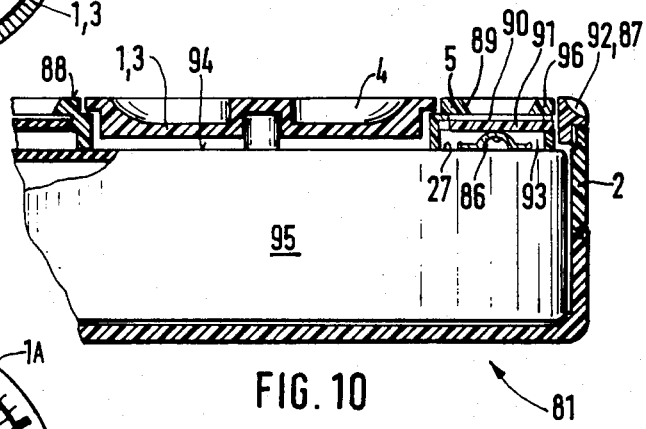
FIG. 10
FIG. 11
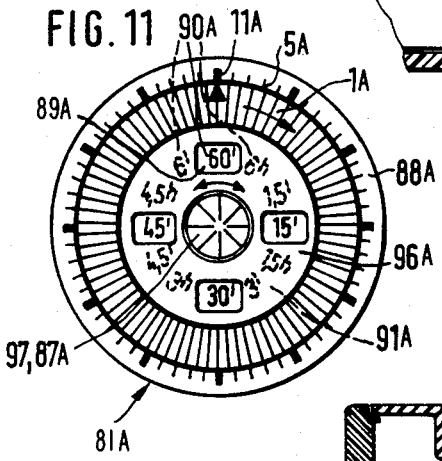
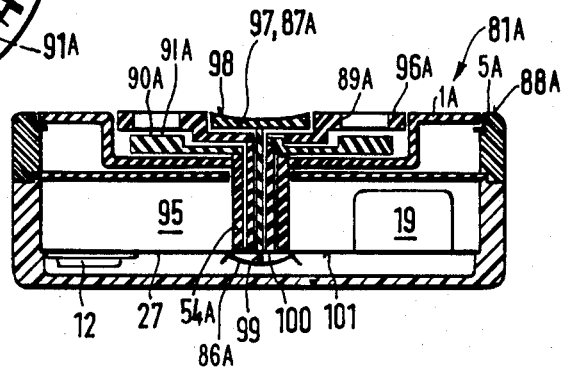
FIG. 12

FIG. 13
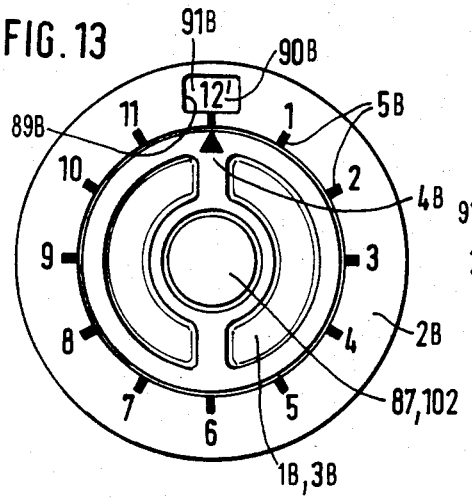
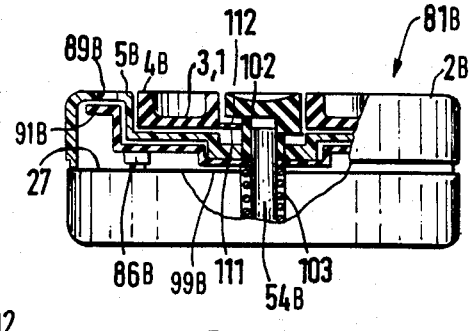
FIG. 14
FIG. 15
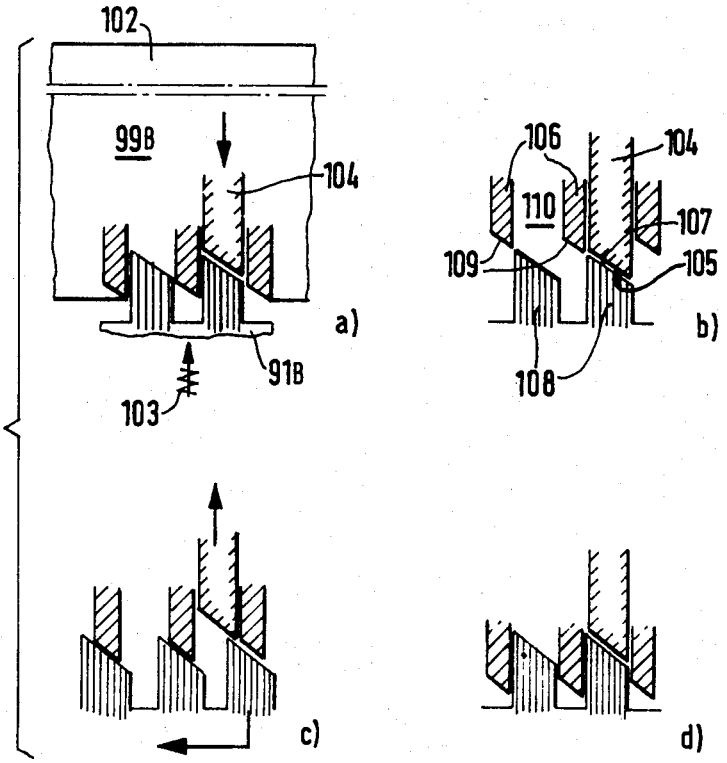

ELECTROMECHANICAL SHORT INTERVAL TIMER

BACKGROUND AND OBJECTS OF THE INVENTION

The invention concerns an electromechanical short interval timer.

Such a timer includes an activating element which can be moved manually from a rest position and then returned to its rest position by means of a motor. The motor is controlled by an electronic timekeeping circuit to return the activating element, whereupon the latter actuates a switch for energizing a signal emitter.

Short interval timers of this type have been exhibited at the European Timepiece and Jewelry Exhibition 1982 (Basel, April, 1982). They exhibit certain advantages resulting from being driven by means of an electromechanical transducer actuated by a quartz stabilized timekeeping circuit (as in the case of conventional quartz analog mechanisms). That is, they may be manufactured less expensively than conventional short interval timers of the type having mechanical spring mechanisms, while providing higher accuracies with respect to the timing period and signal generator actuation.

It is an object of the invention to expand the possible applications of a short interval timer of this type and to further improve its functional reliability.

SUMMARY OF THE INVENTION

This object is attained according to the invention which involves an electromechanical short interval timer. The timer comprises a housing, an actuating element mounted on the housing for manual movement from a rest position, and a control mechanism for returning the actuating element to its rest position. The control mechanism includes an electric motor operably connected to the actuating element, an electric power source, an electric timekeeping circuit connected to the power source for supplying electronic actuating pulses to the motor, and a manually adjustable mechanism for varying the pulse frequency supplied to the motor. A signal emitter is activated in response to the actuating element reaching a predetermined position of its return movement.

Merely by changing the motor pulse frequency, the short interval timer range may be varied without the need for any interference with the functioning of the movement and the dial train or the signal contact output actuated therefrom.

In conventional mechanical short interval timers, switching between different ranges is not feasible in practice, because it would involve a gear switching of the gear train coupling the movement with the dial mechanism. However, such switchable gears are expensive, relatively prone to failure and not suitable for small (household) short interval timers in view of their large size.

In contrast, the solution according to the invention enables the dial train to be driven by a short interval transducer actuator, as in modern quartz timepiece movements, by means of a stepping motor. It receives its step switching pulse recurrence frequency from a timekeeping circuit. The latter consists preferably of a quartz stabilized oscillator circuit, the output frequency of which is reduced to the motor control frequency by means of a frequency divider. This pulse recurrence frequency may thus be switched in a very simple manner, thereby varying the reset movement velocity of the actuating element, i.e., switching the range of the short interval timer. For this purpose, either the output frequency of the frequency divider is modified (by means of different taps or by the insertion of further frequency transformers) or the input frequency in the frequency divider (by frequency transformers behind the oscillator or by affecting the timekeeping circuit itself) is altered. These simple switching modes provide structurally inexpensive but userfriendly switching measures with respect to the display of ranges in the short interval scale, without requiring special instructions for certain complex and not readily comprehended conversions as a function of the range set at the moment. In particular, the range data may be arranged on a range support, which simultaneously also carries the contact springs for range switching (i.e., for the modification of the motor pulse recurrence frequency) and displays the prevailing range (possibly including intermediate range data) in the plane of the short interval scale or even within this scale.

A further disadvantage of short interval timers of this type is the layout effort required for electromechanical (ohmic) contacts in the actuation of the electromechanical transducer and the electroacoustical signal emitter, while such contacts offer only a low operating assurance. For contacting, switching contacts are moving over contact bars provided on an insulating plate, with this arrangement being susceptible to interference by soiling and to wear; and different contacting ranges are laid out in order to initially actuate the acoustic signal emission shortly prior to the return of the indicator dial into its rest position and then, to effect a second contact after passing over this contact range to terminate the actuation of the motor by means of a corresponding actuation of the electronic circuit.

However, this ending of the motor actuation is uncertain, because as the result of mechanical shock or other contacting uncertainties, the actuation of the motor may be reactivated, leading to an undesirable load on the built-in battery power source, whereby the operating range of such an electromechanically driven short interval timer may be significantly shortened. A further disadvantage of these known short interval timers is that a certain minimum sector of the circular time scale is not available for time setting, as this remaining space is functionally required for the layout of the scale onset and scale end stop, and for the further progress of the indicator toggle from the signal emitting position to the motor stop position. In this connection, it is a further disadvantage, that in the case of a new time setting, i.e., rotation from the motor stop position and thus from the rest position, the contact segment for signal emission is again passed over, which in practice, may result in irritation and in any case leads to an undesirable, additional drain on the battery.

According to a further development of the solution according to the invention, claimed as particularly appropriate, the duration of the signal emission is no longer determined by a residual angle of rotation of the actuating element, realized for example in the form of an indicator dial to its rest position; rather, practically upon the attainment of the rest position, a timing circuit provided within the integrated circuit for the actuation of the motor is started, said timing circuit being dimensioned for a definite duration of the signal emission. In this manner, the onset of the signal emission may be placed closely adjacent to the zero point of the scale, i.e., the rest position of the actuating element, thereby increasing the accuracy in time of the onset of the mission of the signal with respect to the duration of the preset short interval time range, which especiall with short time settings has a favorable effect on operating accuracy.

Contacting in this arrangement is conveniently effected by means of a bent contact spring, which is protruding into the path of rotation of a driver element revolving with the actuating element and easily adjusted in view of its configuration, so that it abuts shortly prior to reaching the rest position against a counter contact and triggers the emission of a singal, which is limited in time by the circuit. This signal emission circuit is appropriately designed so that a new signal may be actuated only when the time period of the signal already actuated has been completed and in any case, the contact has been reopened. In this manner, undesirable energy consuming signal emissions triggered by contacting uncertainties are practically eliminated.

A further increase in operating safety results from an improvement in contacting consisting of that the motor remains actuated after a certain residual period of time, thereby increasing the contact pressure of the bent spring against the counter contact and eliminating contacting uncertainties due to deposits of dirt or external mechanical effects. The actuating element, i.e., the indicator dial is moved during this additional actuating phase in a rest position against a mechanical stop, against which it is pressured by means of a frictional rotating connection with the gear train driven by the motor; a definite terminal position is thus assured.

The two time periods, i.e., for the duration of the signal emission and the duration of the trailing actuation of the motor, are initiated conveniently by means of the same bent contacting spring. This not only reduces the equipment volume compared to the provision of separate contacts, but also assures the definite onset of the signal emission shortly perior to the passage of the manually set time range, as simultaneously the trailing run of the motor for the pressuring of the contact is actuated.

To reduce costs, the trialing actuation of the motor within the integrated electronic circuit for the timekeeping actuation of the motor and for the determination of the duration of signal emission, may be chosen to equal in length the duration of the signal, i.e., the same time circuit is used to control the duration of the signal emission and the trailing run of the motor.

In order to be able to utilize a full circular arc for the times scale provided for short interval setting of maximum one hour, according to an advantageous further development of the invention, a pivoting wedge is provided as a pivoting locator, which in case of a complete "winding" of the actuating element (in the sense of setting a maximum time period), may be deflected in one direction to a stop fixedly mounted on the housing and upon the return of the actuating element, into its rest position against an opposing stop on the housing.

This pivoting wedge for the variable stop for the actuating element is articulated advantageously under the actuating disk in the front part of the housing, where it cooperates with an activating rib provided under the actuating element. As by virtue of this variable stop for maximum time setting and for the definition of the rest position of the actuating element, the circular time scale extends over a full circle, i.e., 360 degrees, for the drive gear connection between the motor and the actuating element in a cost reducing manner the standard gear train of a clock movement, from the rotor of the stepping motor to the minute wheel, may be used, whereby the separate manufacturing effort for the production and storage of a special gear train (i.e., for driving a minute disk with a rotating angle of less than 360 degrees in one hour) is eliminated.

THE DRAWING

Additional alternatives and further developments, together with further characteristics and advantages of the invention will become apparent from the description hereinbelow of the preferred examples of embodiment shown in the drawing with restriction to the essential, at an approximately true scale, strongly reduced. In the drawing:

FIG. 6 is a block circuit diagram of an electromechanical short interval timer with electric range switching;

FIG. 7 depicts a modified circuit having range switching;

FIG. 8 is another modified circuit having range switching;

FIG. 9 is a front view of a short interval timer with a range switching handle annularly surrounding the actuating element;

FIG. 10 is an axial section of a portion of the short interval in FIG. 9;

FIG. 11 is a front view of a modified short interval timer wherein the range switching handle is arranged centrally and is surrounded by the actuating element;

FIG. 12 is an axial section of the short interval timer of FIG. 11, with a range switching handle rotatable concentrically with the actuating element;

FIG. 13 is a front view of another modified short interval timer, similar to that of FIG. 11, but wherein the actuating has a rib;

FIG. 14 is an axial section through a portion of the short interval timer according to FIG. 13; and FIGS. 15*a*–15*d* are schematic representations of the mode of operation of a range setting handle of the timer according to FIG. 14.

DETAILED DESCRIPTION OF PREFERRED EMBODIMENTS OF THE INVENTION

Figure 1:
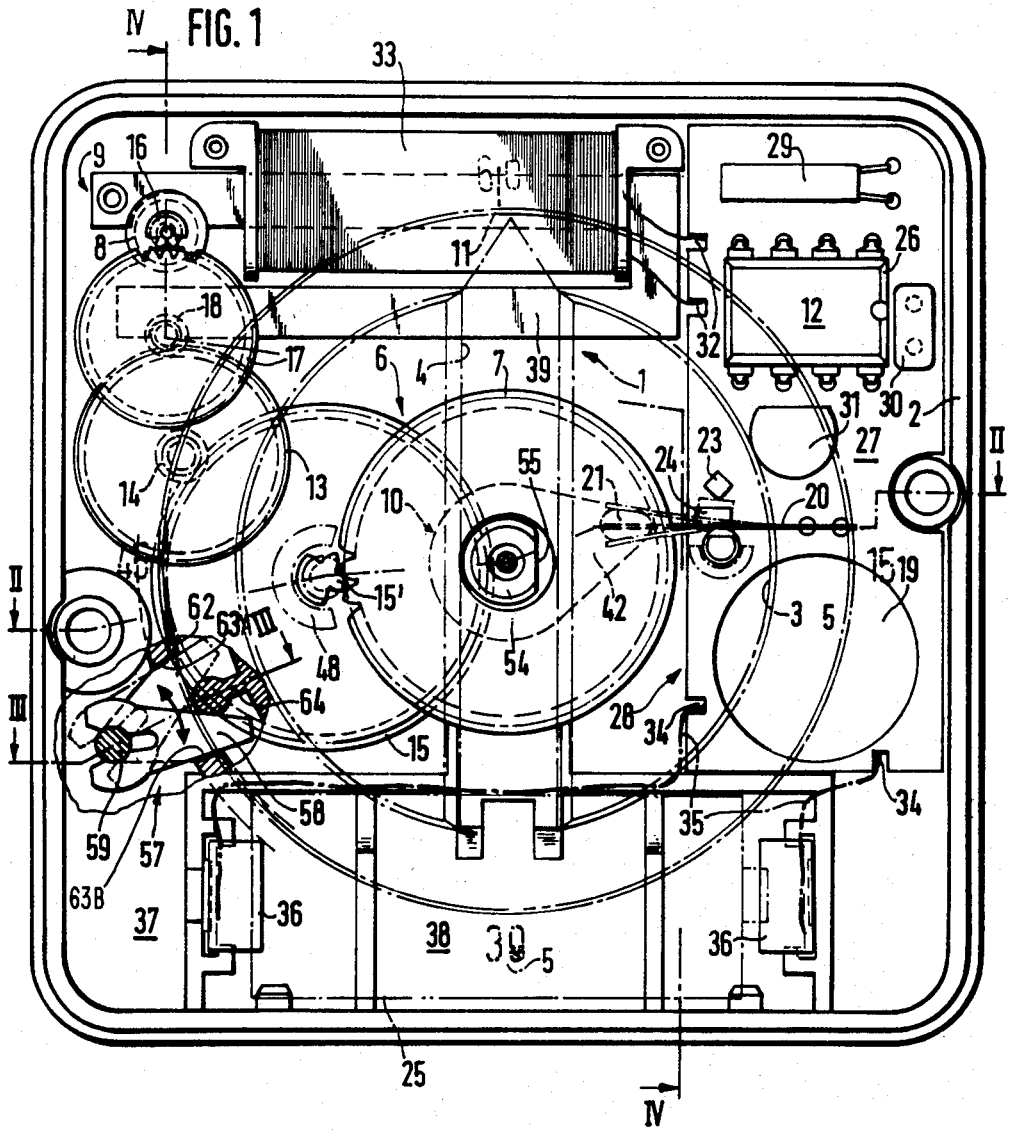
FIG. 1 shows a short interval timer in front view, with the front part of the housing removed, and with the actuating element shown in phantom.
Figure 2:
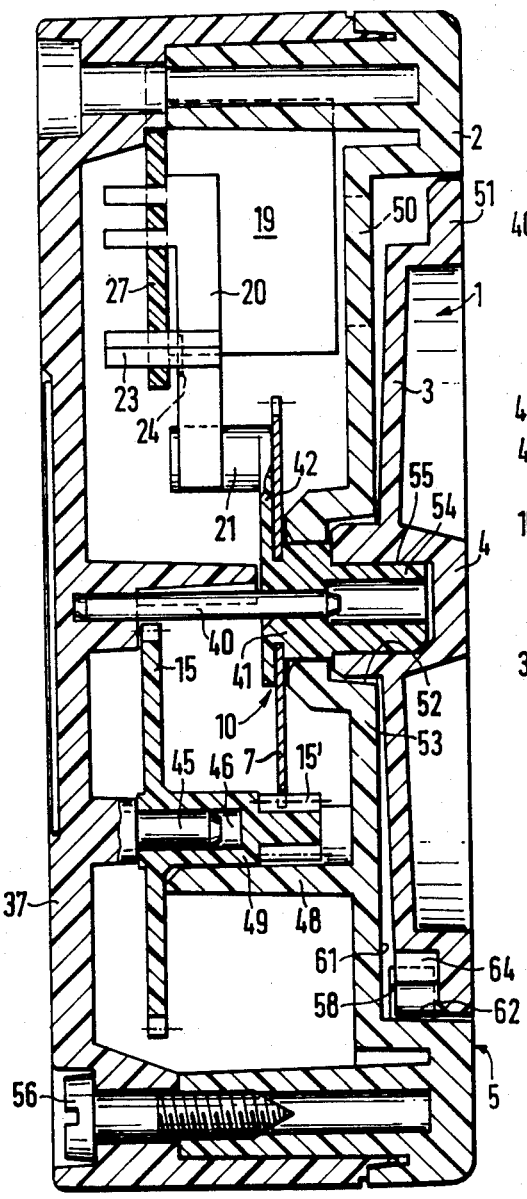
FIG. 2 depicts a longitudinal sectional view taken along line II-II of FIG. 1.

In a preferred short interval timer according to the invention (FIG. 1), the possibilities of range setting are not shown, in order to initially explain the functioning and a preferred configuration of the fundamental mechanism. The electromechanical short interval timer has an actuating element 1 in the form of a rotating disk 3, set and inserted in the manner of a plate in the front part of the housing (FIG. 2). As shown in FIG. 1, a raised rib 4 forms a rotating handle for the disk and extends diametrically across the disk 3. The rib 4 also serves as an indicator pivotable along a time scale 5. A dial train gear works 6 is connected to the minute wheel 7 and is rotated by means of a magnetically positioned rotor 8 of an electromechanical transducer in the form of a stepping motor 9. The disk 3 and its rib 4 is rotated in response to rotation of the minute wheel 7 through a frictional connection 10. On the other hand, the indicator rib 4 may be set manually to an arbitrary time value of the scale 5 from its rest position 11 (corresponding to the zero value on the time scale 5) by rotating the disk 3 relative to the wheel 7 (i.e., the friction connection slips). This avoids the gear train 6 taking part in the movement and producing actuation of the motor circuit 12. It may also be assured by these means that the motor 9 is not blocked mechanically when the rib 4 is already in its rest position.

Following rotation of the rib 4 from the rest position, contacts 20, 23 of a switch are opened. Hence, the gear train 6 is driven by the electronic switching motor circuit 12 via the rotor 8 in such a direction that the disk 3 is moved back in the direction of its rest position 11, due to the frictional connection 10. The electronic circuit 12, produced by a conventional integrating technique, contains a timekeeping circuit, known as an electronic clock drive circuit with a quartz stabilized, timekeeping oscillating circuit. The rotating disk 3 is coupled in rotation by means of the frictional connection 10, with the minute wheel 7. The latter is driven by drive portion 15' of a third wheel 15, which in turn, is connected for rotation with a second wheel 13 by means of a second drive portion 14. An intermediate wheel drive portion 18 of an intermediate wheel 17 connects the second wheel 13 with a drive portion 16 of the rotor 8.

Upon or shortly before the rib 4 reaches the rest position 11, an electroacoustic transducer 19, preferably in the form of a piezo summer signal emitter is temporarily actuated, as explained hereinbelow. The duration of this signal emission is not controlled directly or even indirectly by the remaining return movement of the indicator rib 4 into its rest position 11. Rather, within the integral electronic circuit 12, a time circuit is developed, preferably derived from the frequency divider circuit to reduce the timekeeping oscillating frequency to the step motor actuating frequency. The time circuit causes the electroacoustic transducer 19 to be actuated for a predetermined time period. Following this period of time, the transducer may be reactuated only when the timer circuit is again actuated in accordance with a time setting. This assures that the duration of the signal emission occurs independently of potential contact uncertainties, and tolerance induced trailing run fluctuations of the indicator run 4 in its rest position 11. Accordingly, an optimum duration with respect to battery load and signal effect, is always assured.

Preferably, the signal emission is actuated by means of a spiral spring 20, which is urged against a pinshaped counter contact 23 by a driver element 21 pivotable by the rotating disk 3 and thus moving with the indicator rib 4 shortly prior to reaching the rib rest position 11. Contact between members 20, 23, closes a circuit for the starting of the time circuit for the signal emission. Disposed on the spiral spring 20, in order to achieve a firm contacting, an angled tab 24 is provided which is formed by two blades oriented transversely to and pressed against each other. To effect a contacting, the tab 24 is pressed against an edge of the counter contact 23 which has a prismatic cross-section (as seen in FIG. 1) with respect to the upwardly deflected spiral spring 20.

In order to assure this electromechanical (ohmic) contacting even in the case of potential deposits in the area of the contact surface and independently of possible mechanical shocks, the motor 9 temporarily continues to run even after the onset of the signal emission, so that the spiral contact spring 20 with its contact tab 24 is pressed even more firmly against the counter contact 23, by means of the gear drive 6 and the frictional connection 10. This is achieved in that the contacting of members 20, 20 to initiate the signal emission also causes a time circuit to be triggered within the integrated circuit 12, which determines the temporary trailing (continuing) run of the motor 9.

Preferably, only a sinle ohmic contact, comprising the spiral spring 20 and the counter contact 23 (for the actuation of the signal emission and for the onset of the trailing run of the motor) is provided. Also, the same time circuit is used for the limitation in time of the signal emission and for the trailing run of the motor. Following the expiration of the period of time provided for in this time circuit, the actuation of the motor 9 and the electroacoustic transducer 10, is terminated. The consumption of power of the circuit 12 from a battery 25 serving as the source of energy is thus reduced to the minimum determined by the power consumption of the oscillator and the frequency divider and is less than the spontaneous discharge of a conventional battery 25. The capacity of a standard round cell R1 thus is sufficient for more than 10,000 runs and signal emissions of the short interval emitter. In the usual application of such short interval timers as used in the kitchens of households, the need to replace batteries will be extremely rare.

To contain the circuit 12 cast in the usual manner into a DIP housing 26, a printed circuit board 27 is provided which is laminated to form printed strip conductors. The resulting electronic module 28, which may be preassembled and functionally pretested, is also equipped with an oscillation synchronizing quartz 29, a frequency equalizing capacitor 30, a discrete power transistor 31, and the electroacoustic transducer 19 actuated by it, and the spiral spring 20, together with the counter contact 23. This electronic module 28 further has soldering terminals 32 and 34 for the connection of a motor coil 33 and connecting lines 35. The latter lead to battery contacts 36 fastened to the front walls of a battery chamber 38 molded into the rear part 37 of the housing, such as those described for example in DE-GM No. 80 24 739, the disclosure of which is incorporated by reference herein.

The motor 9 for the time proportional drive of the gear train 6 for the return of the indicator toggle 4 into its rest position 11 may have the configuration described in DE-OS No. 31 49 995 (corresponding to U.S. application Ser. No. 06/450,274), the disclosure of which is incorporated by reference herein. However, a greater holding strength at lower production costs is provided under certain circumstances by a single piece, U-shaped stator plate 39 which is described in detail in DE-GM No. 81 36 794 (corresponding to U.S. application Ser. No. 06/448,055), the disclosure of which is incorporated by reference herein.

The gear train from the motor 9 to the indicator rib 4, includes bearing pins 40 pressed into the housing rear part 37 to receive and rotatably support the rotor 8, the intermediate wheel 17 and a hub 41. On the latter is formed the frictional connection 10 for the minute wheel, as well as the drive element 21 for the contacting deflection of the spiral spring 20, the element 21 being molded onto a projecting holding arm 42. The second wheel 13 with its drive portion 14 is connected for rotation with a shaft 43, which is held rotatingly in a sleeve 44 molded in the rear part 37 of the housing. For the bearing support of the third wheel 15 in the rear part 37 of the housing, a journal 45 is provided as the shaft end of an over-mounted bearing, overlapped by a hub bore 46 of the third wheel 15, as seen in the sectional view of FIG. 2.

Figure 4:
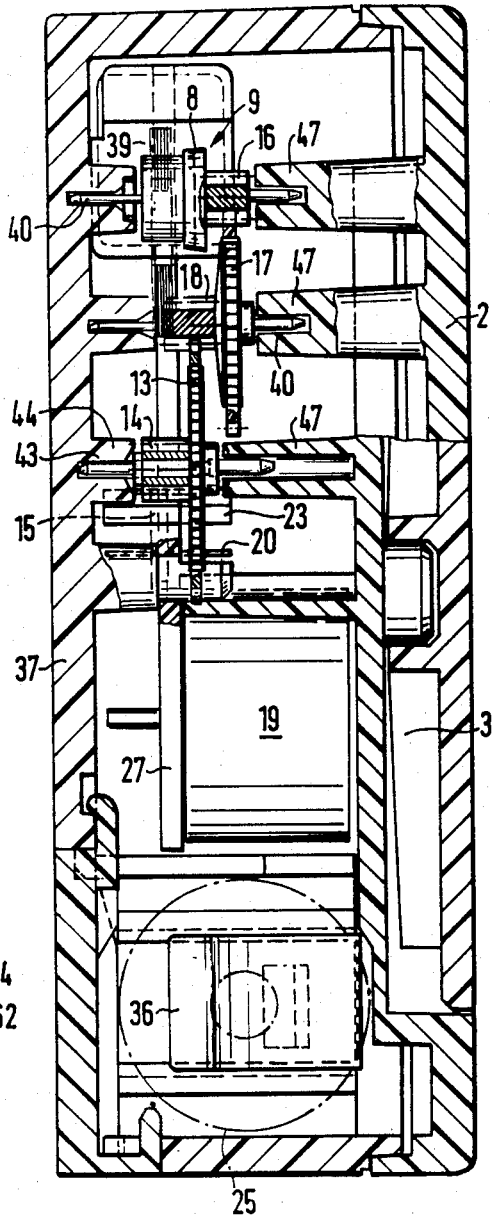
FIG. 4 is a longitudinal sectional view taken along line IV-IV in FIG. 1.

It is further seen in the sectional views according to FIGS. 2 and 4, that hollow columns 47 are molded into the front part 2 of the housing. The columns 47 receive the ends of the bearing pins 40 and shaft 43 facing away from the rear part 37 of the housing. The lengths of the columns 47 are such as to axially immobilize the corresponding gears of the gear train 6, while maintaining the clearance necessary for easy rotary movement. In this sense, a hollow column 48 is associated with the third wheel, which column 48 is recessed for accommodating a driving engagement of the third wheel 15 with the minute wheel 7 and radially supports a hub 49 of the third wheel opposite this engagement (FIG. 2).

In the area of the sound radiating surface of the electroacoustic transducer 19, the front part 2 of the housing has a sound outlet orifice 50. The orifice 50 is located behind a plate-shaped rim 51 of the rotating disk 3 so as to be covered to the outside by the rim 51 is opening as a sound outlet orifice under the rim.

The hub 41 has a shaft end 54 which projects into a center orifice 52 in a depressed center part 53 of the front part 2 of the housing. For the rotating support of the rotating disk 3, the shaft end 54 has at least one axial parallel prismatic surface 55. After the joining of the front part 2 of the housing to the rear part 37 by means of bolts 56, the disk 3 may be frictionally pushed onto the shaft 54 axially from the outside.

In order to be able to use a standard gear train 6 for the return movement of the indicator rib 4 into the rest position (i.e., a gear train 6 used in normal clock movement with a maximum running time of 60 minutes for a rotation of the indicator rib 4), it is necessary that the rib 4 and thus the disk 3 (frictionally joined to the minute wheel 7) execute an angle of rotation of 360 degrees during the return motion of 60 minutes. However, such a rotating angle over a complete circle is not available initially, since a segment of the circular path must be reserved to form a stop, against which (independently of a potential temporary further drive from the circuit 12 and after the actuation of the electroacoustic signal emission) the actuating element 1 abuts to attain its defined rest position 11 and be supported thereat.

Figure 3:
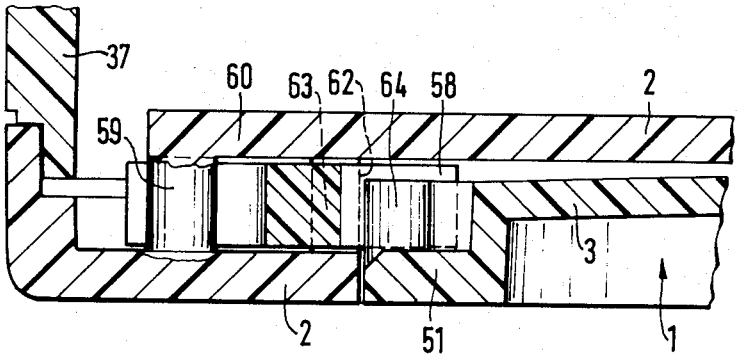
FIG. 3 depicts a detailed, fragmentary longitudinal view taken along line III-III in FIG. 1.
Figure 5:
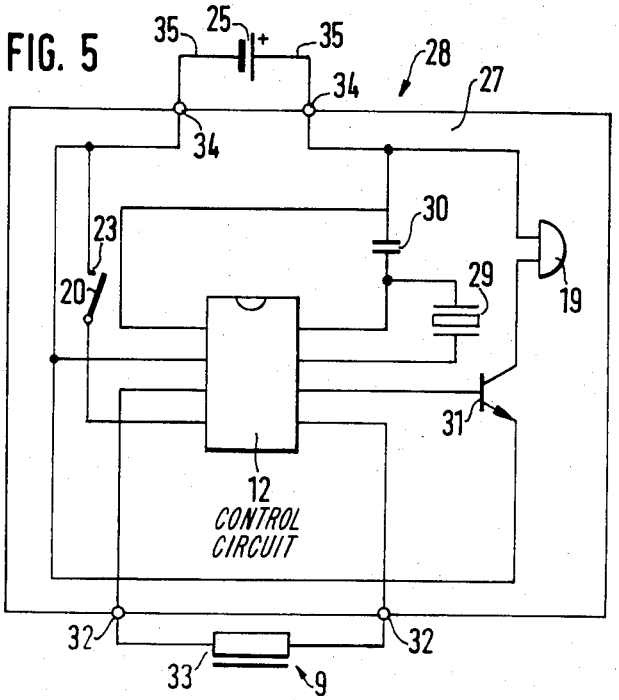
FIG. 5 depicts an electrical control circuit diagram for the timer.

To be able to use a standard and thus inexpensively available clock movement 6, in spite of these restrictions, i.e., to obtain a return angle of the disk 3 of exactly 360 degrees after one hour, a stop 57 is provided which is variable with respect to the return movement for arresting the disk 3 in its rest position. This variable stop 57 (FIGS. 1 and 3) is in the form of a pivoting wedge 58, held by a pivot journal 59 in the radial direction. The journal 59 is molded at the end of a holding arm 60 and extends parallel to the gear axles. This holding arm 60 is arranged as a radial extension on an angularly defined peripheral edge area of a plate-like drawn bottom area 61 of a center area range 53 of the housing front part 2. A bottom rim 62 of the front part 2 is recessed for the passage of the pivoting wedge 58 and to form two stops 63A, 63B. An actuating boss 64, extending radially under the plate rim 51 of the disk 3 abuts laterally against the free end of the pivoting wedge 58 and pivots the latter against the free end of the pivoting wedge 58 and pivots the latter against one stop 63A upon the setting of the indicator rib 4 to the maximum time period in one pivoting direction. After the passing of such period, during the movement of the disk 3 into the rest position 11, the rib 64 pivots the wedge 58 against the opposite stop 63B.

This assures that with a circular time scale 5, a short time interval of 360 degrees corresponding to one hour, but no more, may be set. After the passing of this short time interval, even with the temporarily continuing trailing actuation of the motor, the return motion of the indicator rib 4 is arrested in the definite rest position 11 with a maximum pressure of the spiral contact spring 20 against its counter contact 23, in a defined manner which is uniform for all operations of the timer.

FIG. 6 shows a schematic block diagram of an electromechanical short interval timer 81 of the above-described type. The stepping motor 9 and the transducer 19 are actuated from an electronic circuit 12 with a high frequency oscillating timekeeping circuit 82 and a frequency divider 83 following it in sequence, which are driven by a battery 25.

By means of a range switch 84 (i.e., a frequency selector switch operating under known principles), the pulse frequency recurrence for actuating the motor 9 from the timekeeping circuit 82 of the switching circuit 12 may be selected (FIGS. 7, 8). This determines how many steps the motor 9 executes per unit time and how rapidly therefore the actuating element 1 is returned into its signal emitting and rest position 11. To the period of time to which a certain position on the scale 5 (or the entire circumference of the scale) corresponds may thus be set by means of the range switch 84, through the instantaneous motor pulse frequency recurrence from the circuit 12.

Preferably, the conditions provided by the motor pulse frequency recurrences that may be set individually by means of the range switch 84, are such that simple conversion factors for the scale 5 or obvious overall ranges of the scale are obtained. This is the case, for example, when the entire scale, depending on the position of the range switch 84 includes 6 minutes, 60 minutes, or 6 hours. If particularly short time intervals to the signal emission are of interest, the range switch 84 is set to a motor pulse frequency recurrence, which returns the actuating element 1 from the terminal position of the scale within six minutes to its signaling and rest position. Correspondingly, a motor pulse frequency recurrence is set by means of the range switch 84 for the step motor 9, which returns the actuating element 1 over the entire scale after six hours only, if the emission of the signal is to take place after a very long time interval. The signal emission time period of the short interval timer 81 may thus be varied in arbitrary steps and optional orders of magnitude simply by affecting the motor pulse frequency recurrence and without any functionally critical and structurally expensive intervention in the gear connection between the step motor 9 and the actuating element 1.

For these switchable settings of different motor pulse frequency recurrences according to FIG. 2, outlets 85 may be provided at the frequency divider 83, or by means of frequency converter circuits, such as counters or stable trigger circuits, respectively, whereby means of the range switch 84', the pulse frequency recurrence required for each range to actuate the step motor 9, may be taken off.

Eventually, however, it is less expensive with respect to circuitry to actuate the step motor 9 according to FIG. 8 (as in conventional electronic clock movements) always unaffected from the last stage of the frequency divider 83 and to effect the variation of the motor pulse frequency divider 83. For this purpose, the pulse recurrence supplied by the timekeeping circuit 82 may be stepped down or stepped up, in order to correspondingly reduce or increase the output frequency of the frequency divider 83; or the timekeeping circuit 82, preferably comprising a quartz stabilized oscillator, is stepped down or stepped up directly by means of the range switch 84" by varying the time determining circuit components. In case of a configuration according to FIG. 8, which in its effect is equal to the configuration of FIG. 7, therefore the pulse frequency recurrence whereby the step motor 9 is to be actuated, may be set by the range switch 84; i.e., how rapidly the actuating element 1 of the short interval timer 81 is to be moved back and to what period of time therefore the division of the scale 5 of the short interval timer is corresponding at a given instant.

This electrical switching of the actuation of the step motor 9 is effected by a contact spring 86 which engages the printed circuit 27, the latter carrying in particular the electronic circuit layout 12, a plurality of ohmic contacts connected with the pulse outlets 85 and the timekeeping circuit 82. The spring 86 is connected for movement with a range switch handle 87, to determine the motor pulse frequency recurrence by means of the instantaneous position of the range switch 84 and thus the overall range of the scale or the instantaneous scale division time period. The contact spring 86 may comprise a spiral spring which is urged in the prevailing switch setting against the associated contact on the printed circuit 27. Alternatively, in the interest of favorable contact cleaning conditions, the spring 86 may be shaped as a wiper-spring, to be displaced from one switch setting to the other over the contacts (and the printed circuit 27 located therebetween).

In any case, the part of the printed circuit 27 carrying the contacts for the switching contact spring 86 extends appropriately along an outer surface of the compact movement configuration of the short interval timer 84. Thus, a standardized movement configuration may be equipped with different setting handles for the actuating element 1 and/or the range switch 84, if only the position of the contact spring 86 is coordinated with the counter contacts on the printed circuit 27, without the need for an individual intervention for the switching of the motor frequency. Depending on the configuration and the installation of the range switch handle 87, it is especially appropriate (see the structural examples hereinafter described) to equip the printed circuit 27 with contacts for the range switch 84 in a border area on the surface or close to the center area on the bottom side of the compact movement 95.

The electromechanical short interval timer 81 outlined in a top view in FIG. 9 has a variable actuating element 1 comprising a rotating disk 3 with an indicator rib 4. Also provided is a time scale 5 extending over a full circle. In the scale plate 88, however, at least in the rest position 11 of the indicator, and preferably also at 25%, 50% and 75% of the overall range, a sight window 89 is provided, through which is visible the numerical value of the range which can be set, in this case 12 minutes (and in the further sight windows 89 the corresponding intermediate value of the range). The differentially adjustable ranges (in this case the numerical range data for 12 minutes, 120 minutes, and 12 hours) are located as the range data 90 on the range carrier 91, extending annularly under the sight windows 89 in the scale 5 and fixedly connection in motion with the contact spring 86 (FIG. 10) and thus with the range switch handle 87. The latter is supported rotatingly in the form of a knurled switching ring 92 concentrically outside the scale 5 and is connected with the range carrier 91 and the switching contact spring 86 (FIG. 10). The spring 86 is movable within a bottom tunnel 93 between the scale 5 and the printed circuit 27, the latter being disposed on the cover surface 94 of the short interval timer movement 95.

An embodiment according to FIG. 11 involves an electromechanical short interval timer 81A with a scale extending over a full circle and an actuating element arranged in a concentrically rotatable manner with respect to the scale 5A. In the interest of accurate settings, in view of the longer curve segments between the divisions of the scale 5A, the scale 5A here is located, with its divisional marks, on the outer edge of the front part of the housing. The actuating element 1A is in the form of an annular ringshaped disk adapted for gripping, in the center of which is arranged a diaphragm 96A fixed to the scale 5A and carrying the sight windows 89A for displaying the range data 91A. Under the diaphragm 96A, the range carrier 91A is located rotatingly with respect to the diaphragm. In the FIG. 11 embodiment, the range carrier displays the numerical range data for 6 minutes, 60 minutes and 6 hours, together with the corresponding range parts. The range carrier 91A is joined for rotation with a range switch handle 87A, which is in the form of a centrally located rotating knob 97 with a finger tip gripping depression 98. In principle, the rotating knob 97 could be connected for rotation with the diaphragm 96A in order to pivot the latter with respect to a scale plate 88A fixedly mounted on the instrument, but this would involve the disadvantage that the (terminal) range data 90A would no longer be arranged angularly and rigidly with respect to the rest position 11A of the actuating element, whereby the interpretation of the time indications, i.e., the legibility of the scale, would be somewhat affected.

The rotating knob 97 is mounted on a switch shaft 99, the latter held in a guide tube 100 extending centrally through the movement 95 and mounted rigidly on the instrument. The tube 100 is equipped at its lower end rigidly in rotation with the range switching contact spring 86A, because in this embodiment, the printed circuit 27 with the switching contacts on the bottom surface 101, is accessible to the contact spring 86A. The guide tube 100 also serves to support the actuating element 1A along its shaft end 54A, which here is in the form of a hollow shaft coaxially surrounding the guide tube 100.

In the embodiments according to FIGS. 10 and 12, it is possible in view of the rotating support of the range scale plate 88, 88A that is not limited angularly with respect to its sight window diaphragm 96, 96A to rotate the range switch handle 87, 87A, without restriction, i.e., in any direction of rotation with respect to the rest position 11, from the largest to the smallest range indication 90, 90A. However, as this is not absolutely necessary and the shorter switching path over the intermediate range (in case of more than three ranges, over the intermediate ranges) is more practical in handling, it is sufficient to restrict the setting movement between the range carrier 91, 91A and the scale plate sight window 89, 89A angularly to the segment over which the range data 90, 90A on the range carrier 91, 91A extends. This results in a more stable configuration for the overall structure of the short interval timer 81, 81A as (in contrast to FIG. 10) it is not necessary to install a freely rotating switching ring 92, or, as in the case of FIG. 12, a freely rotating switching shaft 99A. Instead, the parts rigidly mounted on the instrument may be fixedly joined together above and underneath the rotatable range carrier 91, 91A by means of cylindrical structural elements, wherein these cylindrical structural elements are merely provided with segment-shaped passages, to permit the passage of the moving connection between the range switch handle 87, 87A and the range carrier 91, 91A which may be rotated over a limited angle (shown in FIG. 12 at the upper right-hand end of the guide tube 100).

A centered range switch handle 87 is simpler than a rotating center knob 97, which switch handle being in the form of an axially actuable push button 102 in the FIG. 13 embodiment. This push button 102 is arranged in the center of a switching rib 4B for a range display 90B. For axial pressure actuation, this switch handle 87/102 may be smaller on the operating side than is required for the uncomplicated handling of a rotating knob 97 according to FIG. 11; while on the other hand, the configuration according to FIG. 13, in keeping with the conditions according to FIG. 11, makes possible a scale 5 along the periphery of the short interval timer 81B and thus large arc segments between the scale sections.

In principle, it is possible to provide different axial position locks for the push button 102 and to effect the switching of the range switch 84 (FIG. 6) in this manner. This, however, would require an appreciable addition layout effort in order to still be able to arrange the printed circuit with the switching contacts on the outside of the movement 95, i.e., to avoid different conditions of intervention inside the movement 95. Furthermore, clearly different axial locking positions would require a substantial axial structural height of the short interval timer 81B overall, and the obvious coordination of the time scale 5 with the prevailing range indication 90B would also be difficult.

It is more advantageous therefore, as shown in FIGS. 14, 15 to provide in the case of an axially activated push button 102 for range switching, a displacement of the range carrier 91B parallel to the movement of the indicator rib 4 and, as in the embodiments according to FIGS. 9 to 13, combine this with a change in the range display 90B in the area of the scale 5B.

For this purpose, the push button 102 works against an axial return spring 103 rigidly supported on the housing. An axially displaceable shaft 99, joined to the push button 102, is equipped on its mantle surface with at least one axially extending and radially protruding deflecting rib 104. A front axial edge 105 of the rib 104 is inclined with respect to the axial direction. As seen in the representation in FIG. 15, projected onto the plane, the deflecting rib 104 and thus the push button 102 are guided fixedly in rotation between supporting ribs 106, mounted rigidly and in an axially parallel manner on the instrument. In front of the frontal edge 105 of the deflecting rib 104 is the correspondingly inclined frontal edge 107 of one of a plurality of switching ribs 108 distributed over the circular circumference. The rib 108 is connected for rotation with the range carrier 91B and thus with the switch contact spring 86B (FIG. 14). Upon the axial actuation of the push button 102 (FIG. 15) therefore, initially the range carrier 91 is displaced axially, until its switching ribs 108 leave the sliding guide of the supporting ribs 106, at the bottom. As a result of the opposing force of the return spring 103 applied under and against the range carrier 91B, the frontal edge 107 slides along the frontal edge 105 of the deflecting rib and the frontal edges 109 of the supporting ribs, so that each switching rib 108 engages the next slide offset by one division of the supporting rib 106, while pushing back the deflecting rib 104 (FIGS. 15*c*, 15*d*). In this manner, the range carrier 90B has been displaced by one range indication 90B. Obviously, the resetting of the range carrier 91 is not possible in this case; all of the range displays must be switched through by repeated axial pressure on the push button 102, in order to attain the initial position.

If it is to be avoided, that range switching may be performed during the run of the short interval timer 81B, i.e., prior to the rest position 11 of the actuating element, the actuating element disk 3 may appropriately be equipped with a stop collar 111 and above it, the push button 102, with an axially parallel lock pin 112. A recess in the collar 111 is located under the pin of the push button 102 only when the actuating element 1B has been moved back into its rest position. Only then can the downwardly protruding free top end of the lock pin 112 penetrate the plane of the collar 111; only in the rest position 11 of the short interval timer 81B is range switching possible by actuating the push button 102. However, fundamentally there would be no functional interference in case of a premature range switch, as from then on the motor 9 would be controlled with the latered pulse recurrence frequency, which then again corresponds to the instantaneous range display 90B with respect to the prevailing position of the actuating element 1B on the scale 1, again the correct residual time period to the attainment of the rest position is indicated. Depending on the practical conditions of the use of such a short interval timer, irritation or even misunderstandings may occur, if at the start of the operation, following the setting of the actuating element 1B on the scale 5B with a range indication of 90B, at a later time the setting and the running time is altered, for example by another person, without this being recognizable.

In the case of conventional short interval household timers, the transducer 19 is an acoustic signal emitter. Within the scope of the invention, the latter naturally may be replaced in an adaptation to different conditions, for example, in an industrial application by another transducer, such as an electro-optical signal emitter or even by an electromechanical or electronic control stage for the actuation of different processes.

Although the present invention has been described in connection with preferred embodiments thereof, it will be appreciated by those skilled in the art that additions, modifications, substitutions, and deletions may be made without departing from the spirit and scope of the invention, as defined in the appended claims.

What is claimed is:

1. An electromechanical short interval timer comprising:

a housing, an actuating element mounted on said housing for manual movement from a rest position, control means for returning said element to said rest position, and comprising:

an electric motor, operably connected to said actuating element, an electric power source, an electric timekeeping circuit connected to said power source for supplying electronic actuating pulses to said motor, and manually adjustable means for varying the pulse frequency supplied to said motor, and a signal emitter activated in response to said actuating element reaching a predetermined position of its return movement.

2. A timer according to claim 1, wherein said frequency varying means is operable to vary the pulse frequency to said motor by a factor of ten.

3. A timer according to claim 1, wherein said frequency varying means is operable to vary the pulse frequency to said motor by a factor of six.

4. A timer according to claim 1, wherein said frequency adjusting means comprises a frequency selector switch operably coupled to said timekeeping circuit.

5. A timer according to claim 4, wherein said control means includes an oscillator circuit arranged to receive the variable pulses from said timekeeping circuit, said oscillator circuit being operably connected to said motor.

6. A timer according to claim 4, wherein said control means comprises a printed circuit, said frequency selector switch comprising a movable contact spring engageable with said printed circuit.

7. A timer according to claim 4, including a scale carrier on which is provided an indicia scale cooperable with said actuating element to indicate the selected time period, said frequency selector switch including a movable range carrier having a manual actuator for moving said range carrier relative to said scale.

8. A timer according to claim 7, wherein said range carrier includes indicia corresponding to the variable pulse frequencies.

9. A timer according to claim 8, wherein said variable pulse frequency indicia is selectively visible through openings in said housing.

10. A timer according to claim 4, wherein said actuating element comprises a first dial mounted for rotation, said pulse frequency varying means comprising a frequency selector switch which includes a second dial mounted for rotation coaxially relative to said first dial.

11. A timer according to claim 10 including a push button movable transversely relative to the planes of said first and second dials, said push button including an inclined surface which is engageable with an inclined surface of said second dial to cam the latter into incremental rotation each time said push button is pressed manually.

12. A timer according to claim 1, wherein said actuating element is arranged to activate a time-elapse circuit of said signal emitter before said actuating element returns fully to its rest position, said time elapse circuit being self-deactivating after a preset time elapse.

13. A timer according to claim 12, wherein said signal emitter comprises an electroacoustic transducer.

14. A timer according to claim 12 including a spring contact arranged to be contacted and deflected by said returning actuating element to activate said signal emitter.

15. A timer according to claim 1, wherein said actuating element is arranged to activate a timing circuit immediately prior to reaching said rest position for actuating said motor for a preset further duration.

16. A timer according to claim 15 including a spring contact arranged to be contacted and deflected by said actuating element returning to its rest position.

17. A timer according to claim 15, wherein said timing circuit is also connected to said signal emitter for operating the latter.

18. A timer according to claim 17, wherein said timing circuit comprises a portion of said timekeeping circuit.

19. A timer according to claim 1, wherein said actuating element comprises a rotary dial, a stop provided against which said actuating element abuts in both its rest position and its maximum rotated position, said stop being freely movable between first and second positions when engaged by said actuating element in its rest position and maximum rotated position, respectively, such that said actuating element rotates 360 degrees from said maximum rotated position to said rest position.

20. A timer according to claim 19, wherein said stop comprises a rotatably mounted wedge-shaped member.

21. A timer according to claim 20, wherein said actuating element comprises a boss extending into the path of rotation of said wedge-shaped member.

22. A timer according to claim 1 including indicia means operably coupled to said frequency selector switch to be moved simultaneously therewith to display a time period indicia corresponding to the selected pulse frequency.

* * * * *